United States Patent [19]

Hassell et al.

[11] Patent Number: 5,071,497

[45] Date of Patent: Dec. 10, 1991

[54] COMPOSITION FOR USE IN FLARES

[75] Inventors: Cecil D. Hassell, Street, Md.; Lawrence A. Bickford, New Park, Pa.; Sandra D. Smith, Edgewood, Md.; Gartung Cheng, Edison, N.J.

[73] Assignee: The United States of America as representdd by the Secretary of the Army, Washington, D.C.

[21] Appl. No.: 671,604

[22] Filed: Mar. 19, 1991

[51] Int. Cl.[5] ..... C06B 31/02

[52] U.S. Cl. ..... 149/61

[58] Field of Search ..... 149/61

[56] References Cited

U.S. PATENT DOCUMENTS

| | | | |
|---|---|---|---|
| 4,405,762 | 9/1983 | Earl et al. | 149/19.6 |
| 4,915,755 | 4/1990 | Kim | 149/19.4 |
| 4,919,737 | 4/1990 | Biddle et al. | 149/92 |
| 4,976,794 | 12/1990 | Biddle et al. | 149/92 |

*Primary Examiner*—Stephen J. Lechert, Jr.

*Attorney, Agent, or Firm*—Anthony T. Lane; Edward Goldberg; Edward F. Costigan

[57] ABSTRACT

A mixture containing 3,3-bis(aziodomethyloxetane) and strontium nitrate for use in flares.

4 Claims, No Drawings

COMPOSITION FOR USE IN FLARES

The invention described herein may be manufactured, used, and licensed by or for the Government for governmental purposes without the payment to us of any royalty thereon.

FIELD OF USE

This invention relates to a red light emitting pyrotechnic composition for use in a flare.

BACKGROUND OF THE INVENTION

Due to the fact that pyrotechnics are dangerous, they must be handled with due care, particularly for safety sake. What complicates the problem is that the standard light emitting pyrotechnic composition contains a multitude of ingredients, such as fuel, an oxidizer, a coolant, a wetting agent, and a filler.

During manufacture, each of the aforesaid ingredients must be added to each other in a very rigid procedure, and in precise amounts. If this procedure is not carried out in the prescribed manner, there is danger of a hazardous condition which may come into play which could result in a conflagration, fire or even an explosion.

Further, if the ingredients are not incorporated into the composition in the correct amounts, the composition will not function in the correct manner to produce the desired amount of light or may even malfunction or explode.

With evidence of the above arguments and facts in our mind, we have invented a composition which consists of no more than two components or ingredients. This composition functions in the precise manner to produce red light, and is less hazardous to control in manufacture.

DESCRIPTION OF THE INVENTION

The composition we have invented is merely a mixture of an energetic material names 3,3-bis(aziodomethyloxetane) and strontium nitrate which is a light emitting agent.

The range of the energetic material in the composition is between 35 to 65 percent by weight with the remainder being the cited light emitting material for a total of 100 percent by weight which represents the entire composition. If the amount of the energetic material is below 35 percent by weight, the mixture will fail to ignite due to lack of energy. On the other hand, if the amount of light emitting material is present below 35 percent by weight, the latter yield of light will fall below acceptable limits. With either ingredients above 35 percent by weight, the other ingredient is present in an amount which will total 100 percent by weight in any combination for the total composition.

Experiments were carried out with an equal weight of both components of the mixture, i.e., 50 percent by weight for each ingredient. However, such mixtures, although acceptable in functions, were not the best in terms of yield i.e., light.

Based on experience, the best composition contained about 40 percent by weight of the energetic material and 60 percent by weight of the light emitting material.

PROCEDURE OF MAKING

The energetic material and the light emitting material were oven-dried at 125 degrees F. Each of the cited components are then pushed through a no. 16 sieve screen to assure particle size less than 1.19mm in size. The two components are then mixed together, after drying, in a suitable container with a spatula until homogeneous.

RESULTS

The resulting mixture is a smooth burning pyrotechnic that can be disseminated in proper containment to give large yields of light greater than 605 nm wavelengths providing a superior flare composition.

The above cool burning mixture produces no toxic gases. It is used for red flares and is ideal for distress signals and accident-warning flares, such as 26.5 mm flares which are in present use.

The mixture has application in both military and law enforcement operations as a light emitting flare composition and may be distributed through systems, such as the 26.5 mm flare.

It will be apparent to those of ordinary skill in this art that various changes and modifications may be made therein without departing from the scope and spirit of the invention.

What is claimed is:

1. A light producible mixture of 3,3-bis(azidomethyloxetane) which is an energizer and strontium nitrate which is a light producing mixture.

2. A light producible mixture of claim 1 in which said energizer is present in amount of between about 35 and about 65 percent by weight, and the remainder of the total weight being between about 35 and about 65 percent by weight of said light producing mixture.

3. The light producible mixture of cliam 1 in which said energizer is present in amount of about 40 percent by weight and said light producing mixture is present in the amount of about 60 percent by weight.

4. The light producible mixture of cliam 1 in which said energizer is present in amount of about 50 percent by weight and said light producing mixture is present in the amount of about 50 percent by weight.

* * * * *